US007142800B2

(12) United States Patent
Natori et al.

(10) Patent No.: US 7,142,800 B2
(45) Date of Patent: Nov. 28, 2006

(54) INTERMEDIATE TRANSFERRING BELT AND PROCESS FOR PRODUCING THE SAME, IMAGE FORMING APPARATUS, AND IMAGE FORMING PROCESS

(75) Inventors: Yuji Natori, Shizuoka (JP); Minoru Matsuo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 10/963,561

(22) Filed: Oct. 14, 2004

(65) Prior Publication Data

US 2005/0118361 A1 Jun. 2, 2005

(30) Foreign Application Priority Data

Oct. 14, 2003 (JP) ..... 2003-353588
Sep. 16, 2004 (JP) ..... 2004-269313

(51) Int. Cl.
*G03G 15/01* (2006.01)
*G03G 15/20* (2006.01)

(52) U.S. Cl. ..... 399/302; 399/308

(58) Field of Classification Search ..... 399/297, 399/302, 308, 303, 309
See application file for complete search history.

(56) References Cited

U.S. PATENT DOCUMENTS 6,397,034 B1 * 5/2002 Tarnawskyj et al. ..... 399/308
6,596,383 B1 7/2003 Matsuo et al.
2003/0144388 A1 * 7/2003 Swift et al. ..... 524/79

* cited by examiner

*Primary Examiner*—Hoang Ngo
(74) *Attorney, Agent, or Firm*—Oblon,Spivak, McClelland, Maier & Neustadt, P.C.

(57) ABSTRACT

Disclosed is an intermediate transferring belt utilized in order to transfer a toner image formed by developing a latent image on an image bearing member by means of a toner, wherein the intermediate transferring belt comprises a matrix and conductive fine particles, the conductive fine particles are dispersed into the matrix, and the surface resistivity ρs of the outer surface of the intermediate transferring belt is $1.0\times10^{9}$ ohm/square to $1.0\times10^{13}$ ohm/square, and wherein the intermediate transferring belt is applied to an image forming apparatus of which transferring electric field is controlled to 15 MV/m or less when the toner image on the image bearing member is primarily transferred to the intermediate transferring belt.

15 Claims, 6 Drawing Sheets

INTERMEDIATE TRANSFERRING BELT AND PROCESS FOR PRODUCING THE SAME, IMAGE FORMING APPARATUS, AND IMAGE FORMING PROCESS

BACKGROUND OF THE INVENTION

1. Field of the Invention

The present invention relates to an intermediate transferring belt adapted to an intermediate transferring body of full-color copiers and printers, a process for producing the intermediate transferring belt, an image forming apparatus, and image forming process that utilize the intermediate transferring belt respectively.

2. Description of the Related Art

In forming full color images by means of an image forming apparatus such as a copier and printer, such a process is conventionally conducted that the respective mono-color toner images are separately formed on a photoconductor, the respective mono-color toner images are duplicately transferred on an intermediate transferring belt, then the respective mono-color toner images on the intermediate transferring belt are entirely transferred at one time to form a multi-color image by means of an electrostatic force. In forming the multi-color images on such an intermediate transferring body in the electrostatic process, a higher resistivity layer is effectively provided on the substrate of the transferring body for achieve higher image quality. In other words, the control of resistivity is a key technology for electrostatic transferring process. Conventionally, the necessary level of electrostatic force is derived by applying a voltage of 500 to 2000 V, i.e. above 15 MV/m of electric field.

On the other hand, energy saving is demanded also for image forming apparatuses in light of environmental issues in recent years. As for the effective countermeasures of the energy saving, for example, eco-starting apparatuses and low-energy fixing processes have been progressing.

Previously, the higher image quality due to higher resistivity layer of the intermediate transferring belt have been attained through complex-layer construction by providing the higher resistivity layer as the surface layer on the substrate layer.

However, the intermediate transferring belts of the prior art suffer from the delamination between the higher resistivity layer and the substrate layer. That is, when the bonding between the higher resistivity layer and the substrate layer is not sufficient, the higher resistivity layer partly comes to detach and raise from the substrate surface after repeated usages, resulting in non-conductive parts in the higher resistivity layer and occurrences of image nonuniformity.

In order to solve such a problem, an image forming apparatus is disclosed in Japanese Patent Application Laid-Open (JP-A) No. 08-160654, in which a surface layer is produced by dipping step after forming a substrate of an intermediate transferring body. Further, JP-A No. 2003-165127 discloses an intermediate transferring body in terms of the specific gravity of conductive material. In the intermediate transferring body, some thermoplastic resins and thermosetting resins are utilized in addition to polyimide.

JP-A No. 11-109761 discloses a technology concerning an intermediate transferring belt, process for producing the same, and image forming apparatus, in which plural types of carbon with different electric conductivities are included in a film and the carbon is distributed in a gradient along the film thickness.

In such a construction, the surface resistivity is different between the front side and back side, since the plural types of carbon with different conductivities distribute in a gradient along the film thickness, consequently, the intermediate transferring belt may suppress image nonuniformity.

In addition, polyimide resin is a valuable material with respect to strength, thermal resistance, and triboelectrification property. The electrophotographic intermediate transferring belt having a mono-layer construction, formed from polyimide resin and carbon black dispersed therein, have demonstrate superior properties compared with other materials such as plastics.

However, two types of carbon powder with different conductivities and two dispersing steps are necessary to produce the proposed intermediate transferring belt. Moreover, the possibility could not be completely removed that the carbon with different conductivities may flocculate together at local sites around the belt surface.

Further, the resistivity of belts is difficult to be controlled into desired ranges so as to be utilized for various electrographic processes, since the resistivity of belt is often determined depending on material factors such as the resistivity of carbon itself, added amount and the like.

With respect to energy saving, conventional intermediate transferring belts are not satisfactory as explained earlier, since electrostatic force should be derived by applying a voltage of as high as 500 to 2000 V, in other expression about up to 30 MV/m of transferring voltage.

In order to lower the applied voltage, there exist two ways in general. One way is to lower the resistance of the belt, another way is to reduce the applied energy. However, when the resistance of the belt is lowered, the charge required for transferring is not stabilized on the surface or inside the belt and is likely to migrate, as a result the transferring efficiency is unsatisfactory and the transferring is inferior.

On the other hand, when the applied energy is reduced, the absolute amount of charge required for transferring is reduced at the toner layer, the transferring is unsuccessful due to the lowered energy at the toner layer and the insufficient energy in the electric field.

SUMMARY OF THE INVENTION

The object of the present invention is to contribute to energy saving in transferring electrophotographic images so as to respond to nowadays-environmental demands.

The object may be attained by an intermediate transferring belt according to the present invention, which is utilized to transfer a toner image formed by developing a latent image on an image bearing member by means of a toner, comprising a matrix, and conductive fine particles, wherein the conductive fine particles are dispersed into the matrix, the surface resistivity ρs of the outer surface of the intermediate transferring belt is $1.0\times10^{9}$ ohm/square to $1.0\times10^{13}$ ohm/square, and the intermediate transferring belt is applied to an image forming apparatus of which the transferring electric field is controlled to 15 MV/m or less when the toner image on the image bearing member is primarily transferred to the intermediate transferring belt.

In another aspect, the present invention provide a process for producing an intermediate transferring belt utilized in order to transfer a toner image formed by developing a latent image on an image bearing member by means of a toner, comprising: preparing a dispersion containing a matrix material and conductive fine particles, and subjecting the dispersion to centrifugal molding under 3.0 G to 1000 G of centrifugal acceleration.

In still another aspect, the present invention provide an image forming apparatus comprising: an image bearing member capable of forming a latent image and bearing a toner image, a developing unit configured to develop a latent image on the image bearing member by means of a toner, an intermediate transferring belt configured to being primarily transferred the toner image developed by the developing unit, and a transferring unit configured to transfer secondarily the toner image on the intermediate transferring belt to a transfer sheet, wherein the intermediate transferring belt comprises a matrix and conductive fine particles, the conductive fine particles are dispersed into the matrix, the surface resistivity ρs of the outer surface of the intermediate transferring belt is $1.0\times10^{9}$ ohm/square to $1.0\times10^{13}$ ohm/square, and the intermediate transferring belt is primarily transferred the toner image under a transferring electric field of 15 MV/m or less.

In still another aspect, the present invention provide an image forming process comprising: developing a latent image on an image bearing member by means of a toner to form a toner image, transferring primarily the toner image on the image bearing member to an intermediate transferring belt, and transferring secondarily the toner image on the intermediate transferring belt to a transfer sheet, wherein the intermediate transferring belt comprises a matrix and conductive fine particles, the conductive fine particles are dispersed into the matrix, the surface resistivity ρs of the outer surface of the intermediate transferring belt is $1.0\times10^{9}$ ohm/square to $1.0\times10^{13}$ ohm/square, and the intermediate transferring belt is primarily transferred the toner image under a transferring electric field of 15 MV/m or less.

In the intermediate transferring belt, the process for producing the intermediate transferring belt, the image forming apparatus, and the image forming process according to the present invention, the appropriate range of surface resistivity may lead to higher transferring efficiency with lower electric field. Such an intermediate transferring belt may be produced, for example, by making use of centrifugal force.

DESCRIPTION OF THE PREFERRED EMBODIMENTS (Intermediate Transferring Belt)

The inventive intermediate transferring belt, on which toner images are transferred, comprises a matrix and electrically conductive fine particles which are dispersed into the matrix.

The surface resistivity ρs of the outer surface of the belt is $1.0\times10^{9}$ ohm/square to $1.0\times10^{13}$ ohm/square, more preferably $1.0\times10^{9}$ ohm/square to $1.0\times10^{11}$ ohm/square. When the surface resistivity ρs is less than $1.0\times10^{9}$ ohm/square, the charge may undesirably move in traverse direction; when more than $1.0\times10^{13}$ ohm/square, the successive developments is likely to be difficult since the elimination of charge comes to be hard.

Preferably, the volume resistivity ρv is $1.0\times10^{6}$ ohm·cm to $1.0\times10^{11}$ ohm·cm, more preferably is $1.0\times10^{7}$ ohm·cm to $1.0\times10^{10}$ ohm·cm.

Figure 6A:
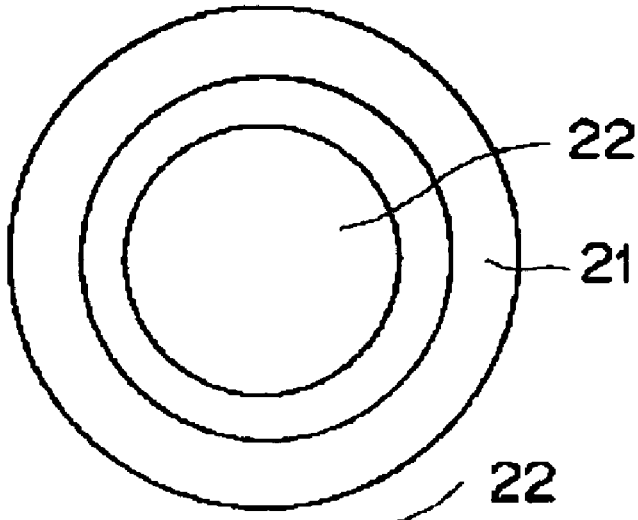
FIG. 6A is a plane view showing an exemplary electrode for determining surface resistivity and volume resistivity.
Figure 6B:
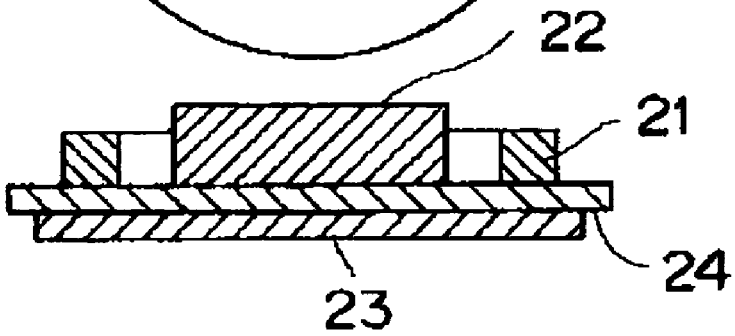
FIG. 6B is a cross section showing the electrode of FIG. 6A.

The surface resistivity ρs and the volume resistivity ρv may be determined, for example, in accordance with JIS K6911. Specifically, the front and back surfaces of the intermediate transferring belt are measured by means of an electrode device as shown in FIGS. 6A and 6B, in accordance with JIS-K6911. The electrode device is constructed by disposing ring electrode 21 and column electrode 22 concentrically on the measuring side of insulating plate 24. The resistance between ring electrode 21 and column electrode 22 is designated as Rs, the resistance between the counter electrode and column electrode 22 is designated as Rv. Earth electrode 23 is disposed at the back side of the measuring face. By measuring these resistances, the surface resistivity ρs and the volume resistivity ρv may be determined.

—Matrix—

The material, size, shape, configuration and the like of the matrix may be properly selected depending on the application without particular limitations. Preferably, the shape is endless, and the configuration is of mono-layer.

As for the material of the matrix, the material utilized for electrophotographic intermediate transferring belts of color copiers is required to be flame retardant, highly strong, and electrically stable. Polyimide resin and polyamideimide resin are significantly superior to other resins in terms of heat resistance and triboelectrification. As for the process for producing endless electrophotographic intermediate transferring belts of polyimide resin or polyamideimide resin, a centrifugal molding process may be exemplified.

The polyimide resin or polyamideimide resin is synthesized from polyamide acid that is the precursor of polyimide or polyamideimide. The polyamide acid undergoes imide-ring closure under the effect of heat or catalyst to turn into polyimide or polyamideimide. The polyamide acid exhibits some solubility in certain solvents and may form a solution.

Into the solution of the polyamide acid, conductive fine particles are dispersed (hereinafter referring to "solution containing polyamic acid mixture").

The conductive fine particles for controlling the resistivity may be selected from various conductive or low resistive particles, for example, metal oxide such as tin oxide and indium oxide, metal particles, carbon particles, mixture thereof and the like. In addition, non-volatile liquids with lower resistivity may be employed solely or in combination with the aforesaid powder.

Preferably, the conductive fine particles are fine carbon particles. Examples of the fine carbon particles include acetylene black, oil-furnace black, thermal black, channel black and the like. The acetylene black is produced by pyrolyzing acetylene in a preheated furnace; oil-furnace black is produced by injecting hydrocarbon oil into a combustion atmosphere in a furnace and subjecting an incomplete combustion while adjusting air rate, then cooling and collecting by means of a cyclone and the resulting carbon black is collected; thermal black is produced by alternative heat-accumulation and pyrolysis of natural gas in a heat accumulator at the temperature of 200 to 1700° C.; channel black is produced by contacting natural gas flame to elongated iron channels thereby to make the resulting carbon adhere to the channel.

The carbon black for the electrophotographic intermediate transferring belt according to the present invention may be other than those described above. In a case that the surface resistance of the belt is desired to be higher, highly conductive carbon black such as acetylene black (e.g., by Denka Co.) and ketchen black (e.g., by Lion Co.) may not be preferable, since even lower content of such carbon blacks leads to higher conductivity.

Preferably, the content of the conductive fine particles in the matrix is 5 to 25 parts by mass, preferably 17.5 to 22.5 parts by mass, based on 100 parts by mass of the resin material in the matrix.

The dispersion of carbon particles may be prepared by means of a ball mill, sand mill and the like. Preferably, carbon particles are dispersed in N-methyl pyrrolidone (hereinafter referring to "NMP") into a certain particle size, then the dispersion of carbon particles and the polyamide acid solution are blended, rather than carbon particles are directly dispersed into the polyamide acid solution.

As for the other organic solvents of the polyamide acid solution in the centrifugal process, N,N-dimethylacetamide $CH_3CON(CH_3)_2$ and those described in JP-A No. 60-28432 are available.

The content of resin material and carbon particles in the solution containing polyamic acid mixture is preferably 10 to 50% by mass based on 100% by mass of the solution containing polyamic acid mixture.

The viscosity of the solution containing polyamic acid mixture is preferably 100 to 15000 cP (centipoise), more preferably is 300 to 8000 cP at 25° C.

The other additives that may be compounded into the solution containing polyamic acid mixture are imidization catalyst, lubricative releasing agent and the like.

Examples of the imidization catalyst include pyridines, picolines, imidazole, quinolines, triethylamine. The content of the imidization catalyst is preferably 0.1 to 50 moles based on one unit of amic acid in the polyamic acid.

Examples of the lubricative releasing agent include silicone compounds, fluorine-containing compounds and the like. The content of the lubricative releasing agent is 0.1 to 10 parts by mass based on 100 parts by mass of the resin material in the matrix.

Injection into a centrifugal cavity is carried out by pouring the solution containing polyamic acid mixture, which is formed previously by blending polyamide acid solution and carbon particle dispersion, into a cavity of the centrifugal molding in a predetermined amount while rotating the cavity. The rotating speed is relatively slow at initial pouring, then the speed is raised gradually to a predetermined speed, and the rotating is maintained for a period at the predetermined speed.

In the production of the intermediate transferring belt according to the present invention, the fine carbon particles in the solution containing polyamic acid mixture tend to migrate along the centrifugal direction due to the difference of mass or specific gravity under a centrifugal force. The degree of the migration is properly controlled in the present invention by adjusting the centrifugal acceleration G.

The accurate measurement and characterization of carbon particle distribution in the film are remarkably important; however, the measurement and characterization of the distribution are considerably difficult.

In the investigations to produce the inventive intermediate transferring belt, we found that higher centrifugal acceleration G may lead to proper film formation owing to maintaining properly the dispersed condition, since the film may be formed under a fluid condition with less convection; and we found that the nonuniform distribution of carbon particles provides the film with suitable properties at semiconductor region, i.e. within a moderate range in resistivity and dielectric constant.

Currently, various improvements have been carried out experimentally, for example, through controlling resistivity and content of carbon black, in order to achieve desired electrical properties. However, definite proposal has not been disclosed yet concerning a process to control surface resistivity while maintaining the volume resistivity.

We have investigated how to control the resistivity in the operative range of processing of coating liquid and/or the solution containing polyamic acid mixture. As a result, the resistivity and the like have turned into controllable as follows.

The surface resistivity can be controlled wile maintaining the volume resistivity. That is, the surface resistivity can be controlled even carbon particles with same resistivity or same material are employed.

Specifically, the distribution condition of carbon particles should be uniform to some degree around the belt surface in a range to obtain the desirable electric properties and not to deteriorate the image uniformity. That is, the distribution condition of carbon particles is believed to be very important since the intermediate transferring belt must perform as an optimum transferring medium, of which property is mainly derived from the distribution condition of carbon particles.

Further, under the rotating process, the solution containing polyamic acid mixture flows into the molding cavity and then the carbon particles begin to separate in the cavity. The carbon particles with higher specific gravity preferentially migrate and flocculate around the surface. When the rotating is carried out at higher speed or the rotating is continued for long period, the polyamide acid molecules having a lower specific gravity surprisingly tend to migrate and gather toward the surface under lower or little centrifugal acceleration.

In a region that the centrifugal acceleration is below than 1.0 G, the surface uniformity is inferior, thus the region is not appropriate for the centrifugal process. In a region that the centrifugal acceleration is above 1000 G, carbon particles tend to flocculate toward the surface.

The prepared solution containing polyamic acid mixture is formed from highly dispersible solvent for carbon particles.

The inside surface of the centrifugal cavity is of the material that can provide superior uniformity of resistivity in plane processing. When coating in plane shape, the force acting on particles is 1 G in the gravitation direction. In the case of centrifugal processing, the force acting on particles is several to thousands times of that, and proportional to the square of the rotating speed.

Accordingly, the centrifugal acceleration G of several thousands is considerably high force, from a view point of the centrifugal force at rotating processing and the force acting on the inside surface of the rotating body, therefore a slight incline of plane may lead to a remarkably high force that induce a local deposition of suspended particles.

The face of cavity has slight incline even though it does not induce any matters in a coating process under 1 G.

As such, it is important to control the centrifugal acceleration thereby to adjust the flocculating property of carbon particles in forming a film through dispersing carbon particles and centrifugally processing the dispersion, thereby the surface resistivity of intermediate transferring belt can be controlled.

When a film, designed to have desirable properties, is produced at below 1 G as previous technology in the art, appropriate images could not be formed by transferring at lower electric field, due to nonuniform deposition of flocculated carbon particles.

However, when the belt is produced under higher G according to the present invention, definite difference may be shown at lower electric filed and proper image forming may be achieved by transferring due to proper distribution or proper nonuniform deposition of carbon particles.

The characterization of the film dispersed with carbon particles in terms of semiconductive property is remarkably difficult. However, we noticed that carbon particles in a dispersion display different mobilities along the centrifugal direction i.e. film-thickness direction, and we estimated that such a phenomenon occurs even within micro regions of the coated solution containing polyamic acid mixture and the nonuniformity of carbon particles corresponds to an important factor on the belt-surface resistivity or the semiconductor property. After investigations as to the appropriate reproducibility we have thought out the present invention. That is, we investigated the phenomenon occurring under high-speed centrifugal conditions, and found the relation of it with the proper semiconductive properties of the intermediate transferring belt.

Further, we found that the molded product of the intermediate transferring belt may be produced that provides definite advantages of lower electric field on conducting image transferring, and that exhibits less occurrences of flocculating nonuniformity at drying process and proper semiconductive property, owing to producing under higher centrifugal acceleration G.

Previously, the processing conditions in forming the belts did not provide significant difference on transferring performance when the transferring electric field is higher; however, the difference is relevant when transferring at lower electric field.

As for the drying condition of the belt after the coating process, the first drying for forming a self-supporting film is preferably conducted at 50 to 210° C. for 30 to 90 minutes, the second drying for imidization is conducted preferably at 200 to 350° C. for 10 to 30 minutes.

That is, it is important to adjust the centrifugal acceleration so as to control the flocculating property, when forming a film through centrifuging and drying the solution containing polyamic acid mixture after dispersion of carbon particles; thereby the surface resistivity of the intermediate transferring belt may be controlled properly.

Further, the travel speed and density of charge display variations in the equivalent circuit depending on the variations of transferring voltage such as ON/OFF.

That is, in the transferring step of toner images, preferably, the applied electric energy forms a potential gradient so as to move or primarily transfer the toner to the intermediate transferring body without causing the charge neutralization at first and further charging into reverse polarity by the applied charge. In other words, undesirable charge neutralization due to ohmic contact and/or small amount of charge injection capable of charging reversibly tend to appear generally along with the relatively large potential difference for conducting toner particle travel. These undesirable phenomena may be avoided according to the present invention.

Figure 2:
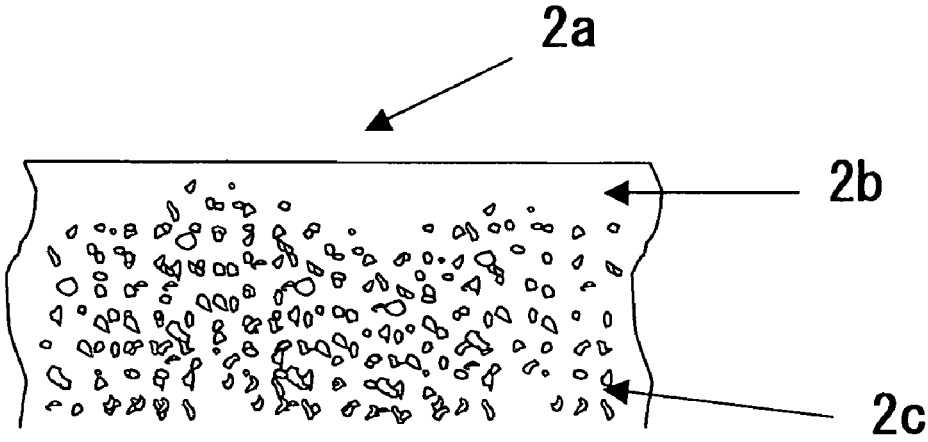
FIG. 2 schematically shows an enlarged cross section of electrophotographic intermediate transferring belt.
Figure 3A:
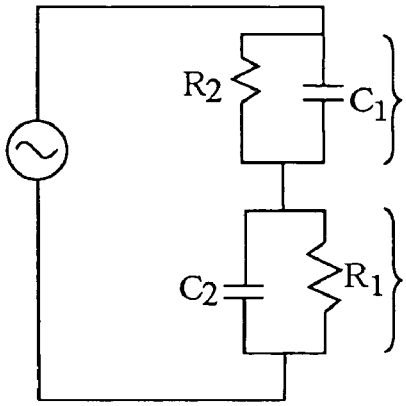
FIG. 3A schematically shows a model of equivalent circuit corresponding to the microstructure of the intermediate transferring belt.
Figure 3B:
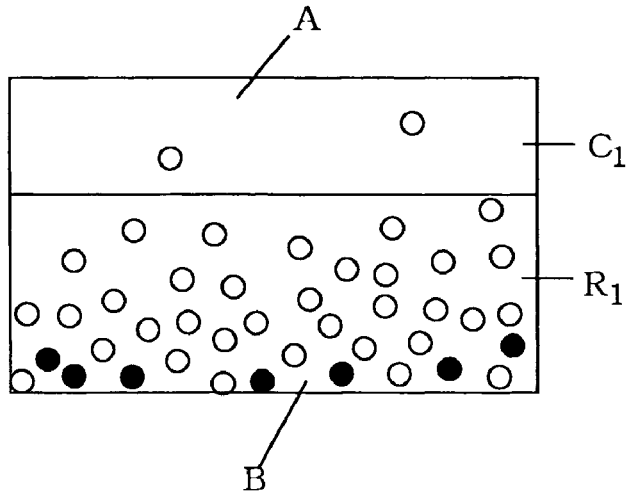
FIG. 3B schematically shows a model of the microstructure, corresponding to the equivalent circuit of FIG. 3A.

The following consideration is one of the reasons that the centrifugal acceleration is important. Assuming a typical example, as shown in FIGS. 3A and 3B, that the belt surface is an exclusive resin layer (A) where very little carbon particles exist and the underlying layer is a mixed layer (B) where plenty of carbon particles exist. Similarly, FIG. 2 show the cross section of intermediate transferring belt, in which 2*a* designates outer surface of the belt, 2*b* designates a matrix layer, and 2*c* designates carbon particles. From these conditions, an equivalent circuit can be considered, in which mixed layer (B) is a resistance element (R1); to the resistance element (R1) is serially connected capacitor element (C1) which is composed of exclusive resin layer (A) therefore is a dielectric element (since capacitance of capacitor is proportional to the dielectric constant of the dielectric, inversely proportional to the gap between the both electrodes, and proportional to the surface area of electrode plate); to resistance element (R1) is connected in parallel capacitance element (C2) that has some dielectric property; and to capacitor element (C1) is connected in parallel the resistance element (R2). The degree of magnitude between resistance element (R1), capacitor element (C2), capacitor element (C1), and resistance element (R2) is important.

Considering the transient build-up at transferring by means of the transferring belt, resistance element (R1) and capacitor element (C2) are in relation of negative proportion in the circuit, and capacitor element (C1) and resistance element (R2) are also in relation of negative proportion. Accordingly, when R2<R1 and C2<C1, and the tendency is more remarkable (actually, this tendency is likely to occur when the control of carbon particle distribution is not appropriate), the equivalent circuit may be approximated to more simple equivalent circuit of R1 and C1 in series connection. The time constant ($\tau$) of the equivalent circuit, which is R1·C1, becomes larger in the case. On the other hand, as the differences between R2 and R1, and C2 and C1 come to smaller, the time constant ($\tau$) of the equivalent circuit comes to smaller. These are preferable relations in a sense; however, the parallel connection of R1·C1 to the equivalent circuit should be considered as a problem matter derived from the charge dissipation toward the belt surface, which is very undesirable phenomenon. This is one of reasons that the range of centrifugal rotation is important in the present invention.

By the way, it is considered that a proximate effect appears between the period or portion where transferring voltage is applied and the period or portion where the voltage is not applied. That is, in order to achieve the correct toner transferring, a semiconductive property is preferably provided to the micro spaces so as to afford sufficient electric field to the portion where the voltage is applied within a short period.

Explanations will be offered as to the conditions of the various parameters.

[Higher Electric Field]

When the intermediate transferring belt is charged, the toner is also charged inversely, i.e. transferring ability is deteriorated. The toner jumps onto the intermediate transferring belt through merely approaching the intermediate transferring belt to the photoconductor due to excessively high charging on the intermediate transferring belt.

[Lower Electric Field]

The force to absorb the toner is weak due to the lower electric field between the intermediate transferring belt and the photoconductor, i.e. the transferring efficiency is low.

Next, the resistivity of belt will be explained.

[Higher Resistivity of Belt]

When the volume resistivity is high, the charge hardly travels into the belt inside; and the electric field around the toner turns into lower when the belt thickness comes to higher.

[Lower Resistivity of Belt]

The charge diffuses inside the belt due to the lower volume resistivity, resulting in lower transferring efficiency. Accordingly, the intermediate transferring belt is required to have a resistivity within a certain range in the present invention.

Figure 1:
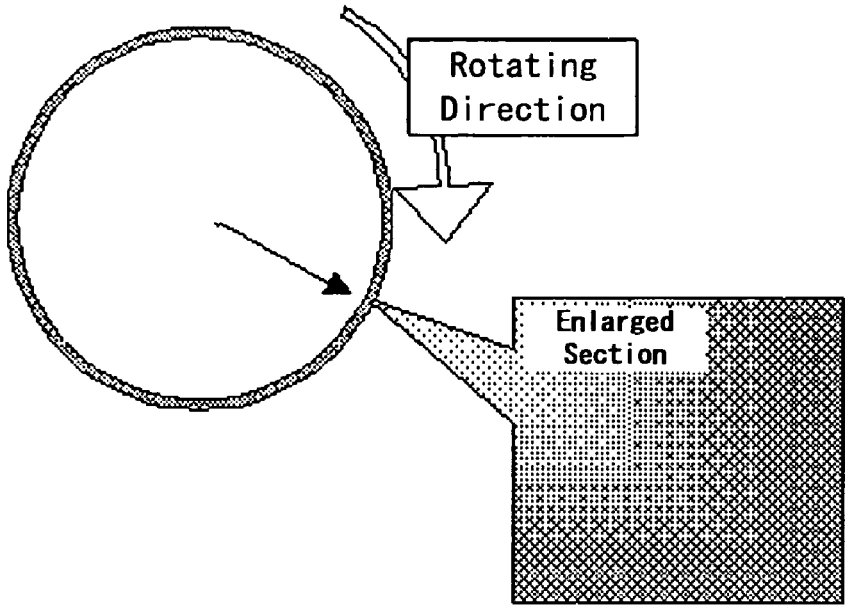
FIG. 1 schematically shows an exemplary centrifugal molding process of an intermediate transferring belt according to the present invention.

FIGS. 1 to 4 show the distribution of carbon particles. FIG. 1 schematically shows an exemplary centrifugal molding process, in which an intermediate transferring belt is formed inside the centrifugal mold. As shown in FIG. 1, the carbon particles exhibit an inclined concentration distribution in the radius direction of the mold. FIG. 2 schematically shows an enlarged cross section of inventive intermediate transferring belt obtained through the centrifugal molding process, in which polyimide rich region 2*b* exists near the surface of the intermediate transferring belt 2*a*, and carbon rich region 2*c* exists under the polyimide rich region 2*b*.

Figure 4:
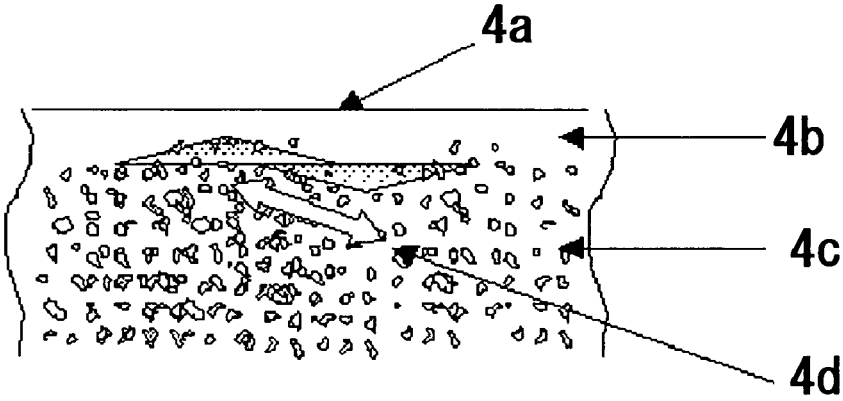
FIG. 4 schematically shows a cross section of the intermediate transferring belt, explaining the migration of carbon particles.

When the belt is subjected to centrifugal molding, the centrifugal force acts in the perpendicular direction to the micro surface of the particles as shown in FIG. 4, in which 4*a* designates the outer surface of intermediate transferring belt, 4*b* designates matrix material layer, 4*c* designates carbon particles, and 4*d* designates the migrating direction of carbon particles. In the case that an incline exists in the micro surface, the vector component acting in the traverse direction can be considered. It is very difficult to determine the small incline, for example one degree or less of the micro surface.

Further, in the centrifugal process, the surface of the solution containing polyamic acid mixture flows backward of the rotating direction by encountering with air resistance. However, the solution containing polyamic acid mixture is not torn off and is uniformed under higher rotating speed, owing to its viscosity and other rheological properties, i.e. the nonuniformity does not appear between the sites in the rotating direction of the belt.

The range of the centrifugal acceleration capable of controlling the resistivity is preferably 1.0 G to 1000 G, more preferably 3.0 G to 1000 G, still more preferably 300 G to 1000 G, in other expression 1600 to 2500 rpm in the case of 120 mm in diameter.

As for an unexpected, important phenomenon when extremely large centrifugal acceleration is applied such as over 1000 G of centrifugal acceleration, carbon particles tends to flocculate or gather nonuniformly around the outer surface of the belt, possibly because the solvent such as NMP in the solution containing polyamic acid mixture comes to fill the concave and/or pore sites of carbon particles, resulting in an urgent increase in the apparent specific gravity of carbon particles.

The flocculation of carbon particles seems to progress especially at excluding solvent such as drying by some reasons. The theory that any chemical adsorptions and sorptions involve the emission of latent heat or heat releasing will be unexceptionally applied to the present invention. In such a case, the heat releasing will compensate at least a part of evaporating heat of organic solvent. Due to these and aforesaid reasons, preferably, the ratio of specific gravity of carbon particles (d2) and the specific gravity of matrix material (d1) is 1.3 or less as (d2/d1).

In addition, organic solvent is evaporated while rotating the centrifugal molding cavity. The evaporation progress the solidification of the polyamide acid, resulting in a column-like film. The evaporation is preferably carried out at higher temperature than room temperature because of efficient and shorter evaporation. The inner surface of the cavity is preferably finished to mirror surface with high accuracy so as not to cause surface irregularity. The size of the cavity depends on the required column film.

The resulting polyamide acid film is further subjected to heating to cause the imide-ring closure in order to satisfy the required properties such as thermal resistance, chemical resistance, and various mechanical properties. The imide-ring closure may be performed by heating, therefore, the remaining solvent in the polyimide film may be completely removed at the same time.

In the actual imide-ring closure, the polyamide acid film may be heated subsequent to heating for solvent evaporation while rotating the film in the cavity. Alternatively, the polyamide acid film may be released and removed from the centrifugal molding cavity, and disposed over a column-like imidization mold prepared separately, then heated entirely by means of a heating unit such as a heating blower.

The resulting polyimide film may be utilized as a functional member after optional processing depending on the application. When the film is applied for an electrographic intermediate transferring belt of color copier, the film is cut to predetermined length, and a fixing member is mounted at each of both the opening portions depending on the application.

In the resulting electrophotographic intermediate transferring belt, the conductive carbon particles are distributed over the outer surface of the belt, the distributed condition of the carbon particles is uniform with respect to the electrophotographic images, and the resistivity of the belt surface is within a desired range.

Further, the intermediate transferring belt does not suffer from detaching and raising of the surface layer, since the construction is different from the conventional type formed of the substrate and surface layer.

FIG. 5 schematically shows an exemplary process for producing an electrophotographic intermediate transferring belt according to the present invention. In producing the intermediate transferring belt, for example, a polyamide acid is dissolved in a suitable solvent such as NMP (N-methyl pyrrolidone) to prepare a polyamide acid solution, and fine carbon powder is dispersed into a suitable solvent such as NMP to prepare a carbon particle dispersion.

Then, the polyamide acid solution and the carbon particle dispersion are blended to prepare a mixture. By the way, plural types of polyamide acid solution and carbon particle dispersion may be prepared and blended all together to prepare a mixture.

Then, the mixture is poured into the cylindrical cavity of centrifugal molding device through inlet tube, for example, and the cylindrical cavity is rotated while the mixture is poured into it. The rotation is continued till the pouring is completed.

After the pouring is completed, the rotating speed of the cylindrical cavity is raised, for example, thereafter the temperature in the cylindrical cavity is gradually raised by means of a sheet-like heater, for example, thereby the solvent in polyamide acid solution layer coated inside the cylindrical cavity is evaporated during the processing to prepare a polyimide acid belt. By the way, the heating of cylindrical cavity may be carried out by other heating means such as a furnace, rather than sheet-like heater.

Then, polyamide acid belt is removed from cylindrical cavity and is set up on imidization mold, and the polyamide acid belt on the imidization mold is disposed in furnace, for example, and heated to prepare an intermediate transferring belt according to the present invention.

The followings are image forming apparatuses and image forming processes adapted to utilize the intermediate transferring belt according to the present invention.

(Image Forming Apparatus and Image Forming Process)

The image forming apparatus adapted to utilize the intermediate transferring belt according to the present invention comprises a image bearing member, image forming unit, developing unit, transfer unit and fixing unit, and may further comprise the other units, for example, a charge-eliminating unit, cleaning unit, recycling unit and control unit, if required.

The image forming process adapted to utilize the intermediate transferring belt according to the present invention comprises a latent image forming step, developing step, transferring step and fixing step, and may further comprise the other steps, for example, a charge-eliminating step, cleaning step, recycling step and controlling step, if required.

—Latent Image Forming Unit and Latent Image Forming Step—

The latent image forming step is one which forms a latent image on the latent image bearing member or photoconductor.

The latent image bearing member or photoconductor is not particularly limited as to the material, shape, construction or size. For example, its shape may be drum-like, and its material may be that of an inorganic photoconductor, such as amorphous silicon or selenium, or an organic photoconductor such as polysilane or phthalopolymethane. Among these, amorphous silicon is preferred from the viewpoint of long life.

The latent image may be formed, for example, by uniformly charging the surface of the latent image bearing member, and irradiating it imagewise, which may be performed by the latent image forming unit.

The latent image forming unit, for example, comprises a charger which uniformly charges the surface of the latent image bearing member, and a light irradiator which exposes the surface of the latent image carrier imagewise.

The charging may be performed, for example, by applying a voltage to the surface of the latent image bearing member using the charger.

The charger may be suitably selected depending on the application, for example, contact chargers such as a conductive or semi-conductive roller, brush, film or rubber blade, and non-contact chargers using corona discharge such as corotron and scorotron are exemplified.

The light irradiation may be performed by irradiating the surface of the latent image bearing member imagewise, using the light irradiator for example.

The light irradiator may be suitably selected depending on the application provided that it may expose the surface of the latent image bearing member charged by the charger in the same way as the image to be formed, for example, a light irradiator such as copy optical system, rod lens array system, laser optical system and liquid crystal shutter optical system may be exemplified.

In addition, a backlight system may be employed wherein the latent image bearing member is exposed imagewise from its rear surface.

—Developing Unit and Developing Step—

The developing unit is not particularly limited provided that it may develop an image for example by using the developer, and may be suitably selected from among those known in the art. Examples are those which comprise an image-developer housing the developer, and which may supply the developer with contact or without contact to the latent image.

The developing step is one which develops the latent image using the developer to form a visible image.

The visible image may be formed for example by developing the latent image using the developer, which may be performed by the developing unit.

The image-developer may be the dry type or wet type, and may be a monochrome image-developer or a multi-color image-developer. Examples are units comprising a stirrer which charge the developer by friction stirring, and units comprising a rotatable magnet roller.

In the image-developer, the toner and the carrier may for example be mixed and stirred together. The toner is thereby charged by friction, and forms a magnetic brush on the surface of the rotating magnet roller. Since this magnet roller is arranged near the latent image bearing member or photoconductor, part of the toner in the magnetic brush formed on the surface of this magnet roller moves to the surface of this latent image bearing member or photoconductor due to the force of electrical attraction. As a result, the latent image is developed by this toner, and a toner image is formed on the surface of this latent image bearing member.

The developer to be housed in the image-developer is the developer containing the toner. The developer may be single-component or double-component developer.

—Transferring Step and Transferring Unit—

The transferring step is one which transfers the visible image to a transfer sheet. The primary transfer is performed such as, using the intermediate transferring belt according to the present invention as an intermediate transferring body, the visible image is primarily transferred to the intermediate transferring belt; and the second transfer is then performed wherein this visible image is secondarily transferred to a transfer sheet. Preferably, using toner of two or more colors and preferably full color toner, the primary transfer step transfers the visible image to the intermediate transferring belt form duplicated transfer images, and the second transfer step transfers the duplicated images to the transfer sheet.

The transfer can be realized, for example, by charging the latent image bearing member or photoconductor using a transferring charger, which can be performed by the transferring unit.

The transferring unit (the first transferring unit and the second transferring unit), preferably comprises an image-transferer which charges by releasing the visible image formed on the latent image bearing member or photo conductor to the transfer sheet side. There may be one, two or more of the transferring unit.

The image-transferer may be a corona transfer unit which functions by corona discharge, a transfer belt, a transfer roller, a pressure transfer roller or an adhesion transfer unit.

The transfer sheet is typically plain paper, but is not specifically limited, may be selected depending on the application and includes, for example, a polyethylene terephthalate (PET) base for overhead projector (OHP).

The fixing step is one which fixes the visible image transferred to the transfer sheet using a fixing apparatus. This may be carried out for developer of each color transferred to the transfer sheet, or in one operation when the developers of each color have been laminated.

The fixing apparatus is not particularly limited and may be suitably selected from heat and pressure unit known in the art. Examples of heat and pressure unit are a combination of a heat roller and pressure roller, and a combination of a heat roller, pressure roller and endless belt.

The heating temperature in the heat-pressure unit is preferably 80° C. to 200° C.

Also, in the present invention, an optical fixing unit known in the art may be used in addition to or instead of the fixing step and fixing unit, depending on the application.

The charge-eliminating step is one which applies a discharge bias to the latent image bearing member to discharge it, which may be performed by a charge-eliminating unit.

The charge-eliminating may be suitably selected from charge-eliminating unit known in the art provided that it can apply a discharge bias to the latent image bearing member, for example, a discharge lamp.

The cleaning step is one which removes electrophotographic toner remaining on the latent image bearing member, and may be performed by a cleaning unit.

The cleaning unit may be suitably selected from cleaning unit known in the art provided that it can remove electrophotographic toner remaining on the latent image bearing member, for example, a magnetic brush cleaner, electrostatic brush cleaner, magnetic roller cleaner, blade cleaner, brush cleaner and web cleaner are exemplified.

The recycling step is one which recycles the electrophotographic toner removed by the cleaning step to the developing step, and may be performed by a recycling unit.

The controlling step is one which controls the respective processes, and may be properly implemented by a control unit.

The controlling unit is not particularly limited and may be suitably selected depending on the application provided that it can control the operation of each of the unit.

An embodiment of the image forming process adapted to utilize the intermediate transferring belt according to the present invention will be illustrated with reference to FIG. 8. The image forming apparatus 100 shown in FIG. 8 comprises photoconductor drum 110 (hereinafter briefly referred to as "photoconductor 110") as the latent image bearing member, charging roller 120 as the charging unit, light irradiator 130 as the exposing unit, image-developer 40 as the developing unit, intermediate image transferring belt 50, cleaner 60 serving as the cleaning unit and having a cleaning blade, and charge-eliminating lamp 70 as the charge-eliminating unit.

The intermediate transferring belt 50 is an endless belt, being designed such that it is spanned over three rollers 51 and driven in the direction indicated by an arrow. One of the three rollers 51 serves as a bias roller for applying a bias for image transfer to the intermediate transferring belt 50. A cleaner 90 for cleaning the intermediate transferring belt 50 is arranged in the vicinity of the intermediate transferring belt 50 and includes a cleaning blade. A transfer roller 80 as the transfer unit faces the intermediate transferring belt 50 and transfers a toner image from the intermediate transferring belt 50 to a transfer sheet 95 serving as a final transfer member. A corona charger for applying charges onto the developed image on the intermediate transferring belt 50 is arranged around the intermediate transferring belt 50. The corona charger is disposed between a contact area of the photoconductor 110 and the intermediate transferring belt 50 and another contact area of the intermediate transferring belt 50 and the transfer sheet 95 in the direction of rotation of the intermediate transferring belt 50.

The image-developer 40 is comprised of a developing belt 41 as a developer carrier, black developing unit 45K disposed around the developing belt 41, yellow developing unit 45Y, magenta developing unit 45M and cyan developing unit 45C. The black developing unit 45K includes a developer tank 42K, developer feed roller 43K and developing roller 44K. The yellow developing unit 45Y includes a developer tank 42Y, developer feed roller 43Y and developing roller 44Y. The magenta developing unit 45M includes a developer tank 42M, developer feed roller 43M and developing roller 44M. The cyan developing unit 45C includes a developer tank 42C, developer feed roller 43C and developing roller 44C. The developing belt 41 is in the form of an endless belt and is spanned over plural belt rollers rotatably, a part of which is in contact with the photoconductor 110.

Figure 8:
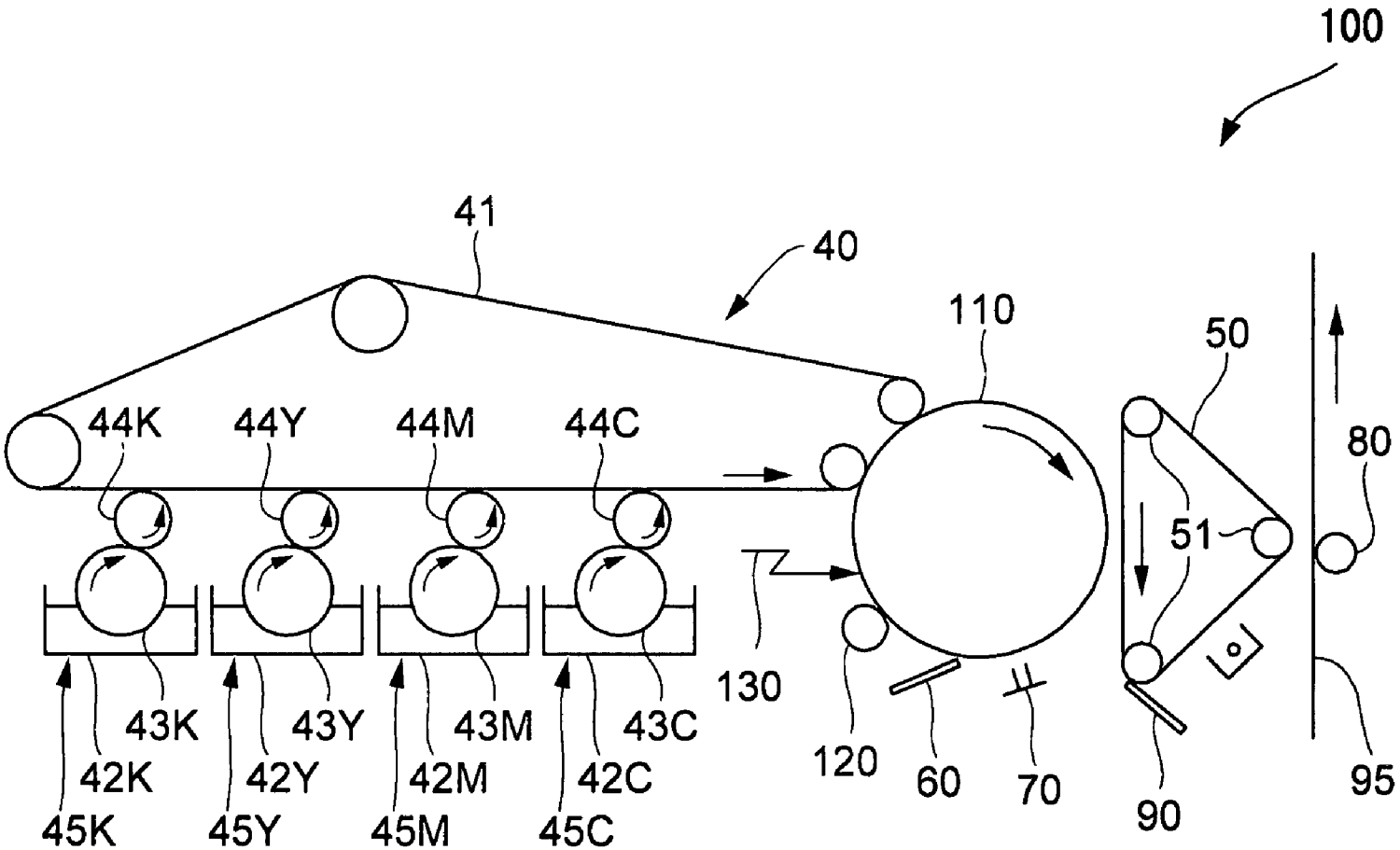
FIG. 8 schematically shows an exemplary image forming apparatus according to the present invention.

In the image forming apparatus 100 shown in FIG. 8, for example, the charging roller 20 uniformly charges the photoconductor 110. The light irradiator 30 applies light to the photoconductor 110 imagewise to form a latent image thereon. The image-developer 40 feeds the developer to the photoconductor 110 to thereby develop the latent image thereon to form a visible image. The visible image is transferred (primary transfer) to the intermediate transferring belt 50 and then transferred (secondary transfer) to the transfer sheet 95 by action of a voltage applied by the rollers 51, to thereby form a transferred image on the transfer sheet 95. Untransferred developers on the photoconductor 110 after the transferring procedure are removed by the cleaner 60, followed by elimination of residual charges by the charge eliminating lamp 70 to be subjected to another charging procedure.

The present invention will be illustrated in more detailed with reference to examples given below, but these are no more than to explain the present invention and should not be construed as limiting the present invention.

EXAMPLE 1

An intermediate transferring belt according to the present invention was produced as follows.

Initially, a polyamide acid (specific gravity: 1.5 g/cm$^3$ as resin itself after imide-ring closure) was dissolved in NMP at a concentration of 20% by mass to prepare a matrix material, and a furnace carbon black of Asahi #60H (N-568)

Figure 5A:
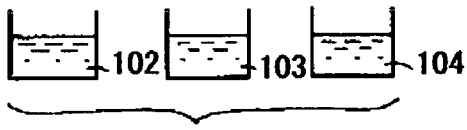
FIG. 5A schematically shows raw materials for producing an intermediate transferring belt.

(specific gravity being 1.8 g/cm$^3$, however, the apparent specific gravity being considerably less than the specific gravity of solution containing polyamic acid mixture) was dispersed into NMP by means of a sand mill to prepare a dispersion of particle size 0.04 μm, as shown in FIG. 5A.

Figure 5B:
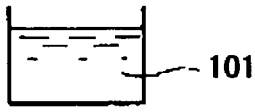
FIG. 5B schematically shows a compound of raw material for producing an intermediate transferring belt.

Then, matrix material 102 and carbon particle dispersion 103 were blended to prepare a mixture (hereinafter referring to "solution containing polyamic acid mixture 101"), as shown in FIG. 5B. By the way, reference number 104 denotes the other optional ingredients if necessary. The solid content of carbon particles Asahi #60H was 22 parts by mass based on 100 parts by mass of polyimide resin material in the solution containing polyamic acid mixture 101.

Figure 5C:
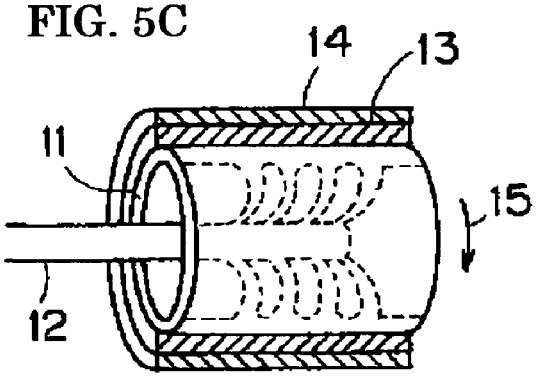
FIG. 5C schematically shows an injection process of raw material for producing an intermediate transferring belt.

Then, the solution containing polyamic acid mixture 101 was poured into cylindrical cavity 13 of centrifugal molding device through inlet tube 12, as shown in FIG. 5C. The cylindrical cavity 13 was 124 mm in inner diameter and 250 mm in length. The cylindrical cavity 13 was rotated at 10 rpm while the solution containing polyamic acid mixture 101 was being poured into it, as shown by arrow 15 in FIG. 5C. The rotation was continued till the pouring was completed.

Figure 5D:
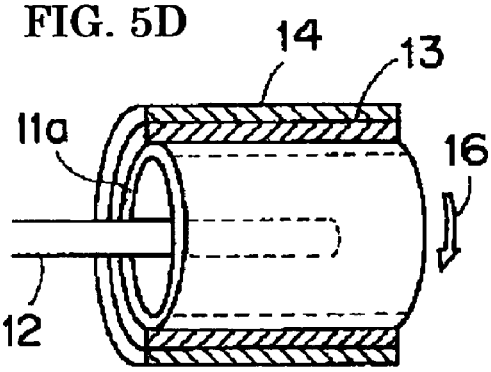
FIG. 5D schematically shows a centrifugal molding process for producing an intermediate transferring belt.

After the pouring was completed, the rotating speed of the cylindrical cavity 13 was raised to 400 rpm, as shown by arrow 16 in FIG. 5D. The centrifugal acceleration was 11 G at that time. Thereafter, the temperature in the cylindrical cavity 13 was gradually raised by means of sheet-like heater 14 and the cylindrical cavity 13 was maintained at the temperature of 100° C. The solvent in polyamide acid solution layer 11*a* coated inside the cylindrical cavity 13 was evaporated during the processing.

Figure 5E:
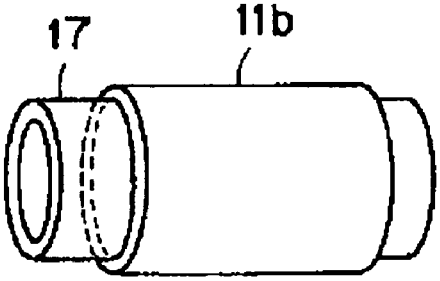
FIG. 5E schematically shows an exemplary imidization mold for producing an intermediate transferring belt.

Then, polyamide acid belt 11*b* was removed from cylindrical cavity 13 and was set up on imidization mold 17, as shown in FIG. 5E, after sufficiently volatilizing the solvent from the solution containing polyamic acid mixture layer 11*a*.

Figure 5F:
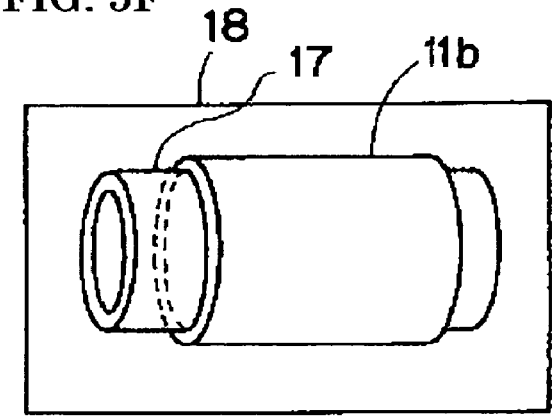
FIG. 5F schematically shows an exemplary heating condition for producing an intermediate transferring belt.

Then, imidization mold 17 set up with polyamide acid belt 11*b* was disposed in furnace 18 maintained at about 300° C. and was heated for 20 minutes, as shown in FIG. 5F, to prepare an intermediate transferring belt according to the present invention.

The front and back surfaces of the resulting intermediate transferring belt were measured by means of an electrode device as shown in FIG. 6 in accordance with JIS-K6911. The electrode device was constructed by disposing ring electrode 21 and column electrode 22 concentrically on the measuring side of insulating plate 24, as shown in FIG. 6. In the measurement, earth electrode 23 was disposed on the back side of measuring face. The surface resistivity ρs was $1.0\times10^{11}$ ohm/square, and the volume resistivity ρv was $2.0\times10^{9}$ ohm·cm.

Figure 7:
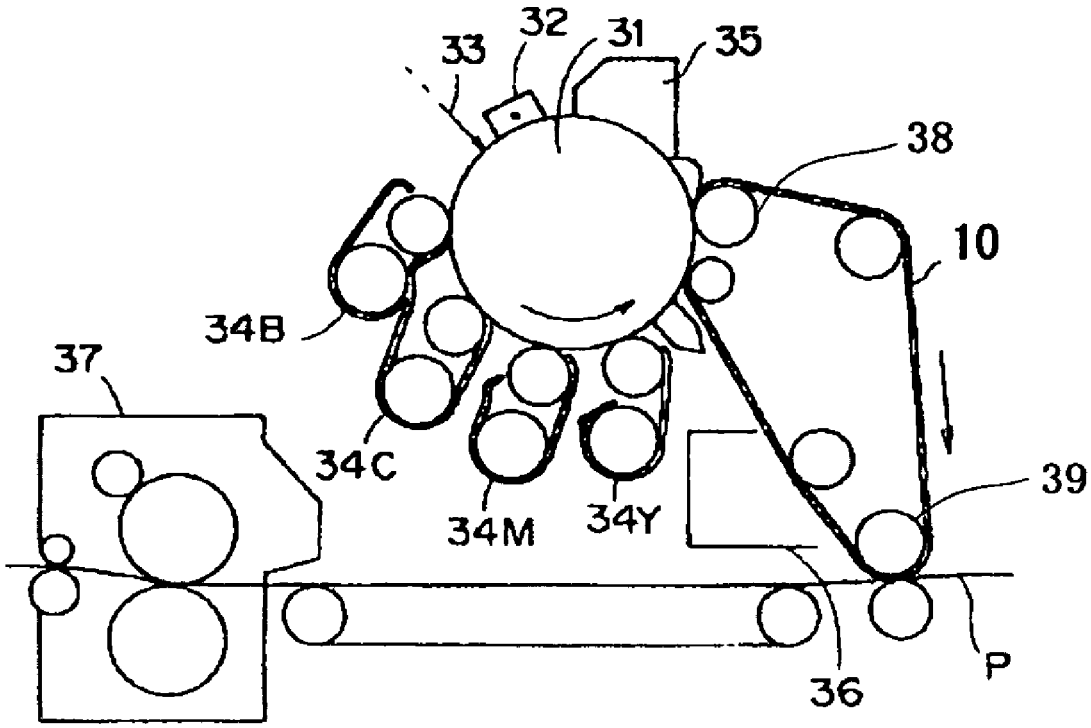
FIG. 7 schematically shows an exemplary image forming apparatus equipped with an intermediate transferring belts according to the present invention.

The image forming apparatus shown in FIG. 7 was equipped with photoconductor drum 31 configured to be charged so as to perform as an image bearing member, charger 32 configured to charge photoconductor drum 31, irradiating portion 33 configured to irradiate the charged photoconductor 31, developing device 34B, 34C, 34M, and 34 Y configured to develop toner images by developing the latent images on photoconductor drum 31, intermediate transferring belt 10 configured to transfer intermediately the toner images developed on the photoconductor, primary transferring roll 38 and the DC voltage-applying device, and secondary transferring roll 39 configured to transfer secondarily the toner images from intermediate transferring belt 10 and the DC voltage-applying device.

Further, the image forming apparatus comprised photoconductor cleaner 35 configured to clean photoconductor drum 31, transferring belt cleaner 36 configured to clean intermediate transferring belt 10, and fixing device 37 configured to fix on paper the toner images transferred on transferring paper P that was a transfer sheet for being secondarily transferred the toner images from intermediate transferring belt 10.

The developing device was comprised of black developing device 34B; cyan developing device 34C, magenta developing device 34M, and yellow developing device 34Y for the subtractive primary three colors.

By means of the image forming apparatus, copies were is prepared in a condition of 12.5 MV/m of transferring electric field. As a result, a proper electrophotographic process was achieved, and clear and superior images were obtained.

EXAMPLE 2

An intermediate transferring belt was prepared in the same manner as Example 1, except that the rotating speed of the cylindrical cavity 13 was raised to 1000 rpm after the pouring of solution containing polyamic acid mixture 101 was completed, and the centrifugal acceleration was 69 G at that time.

The surface resistivity ρs of the intermediate transferring belt was $5.0\times10^{11}$ ohm/square, and the volume resistivity ρv was $9.0\times10^{8}$ ohm·cm.

By means of the image forming apparatus, copies were prepared in a condition of 12.5 MV/m of transferring electric field. As a result, a proper electrophotographic process was achieved, and clear and superior images were obtained.

EXAMPLE 3

An intermediate transferring belt was prepared in the same manner as Example 1, except that the rotating speed of the cylindrical cavity 13 was raised to 900 rpm after the pouring of solution containing polyamic acid mixture 101 was completed, and the centrifugal acceleration was 56 G at that time.

The surface resistivity ρs of the intermediate transferring belt was $2.0\times10^{10}$ ohm/square, and the volume resistivity ρv was $2.0\times10^{9}$ ohm·cm.

By means of the image forming apparatus, copies were prepared in a condition of 12.5 MV/m of transferring electric field. As a result, a proper electrophotographic process was achieved, and clear and superior images were obtained.

COMPARATIVE EXAMPLE 1

An intermediate transferring belt was prepared in the same manner as Example 1.

By means of the image forming apparatus, copies were prepared in the same manner as Example 1, except that the transferring electric field was changed to 30.0 MV/m at the primary transferring. As a result, a proper electrophotographic process could not be achieved. Specifically, significant transferring nonuniformity of the toner was induced due to variable carbon densities on the intermediate transferring belt, thus acceptable transfer of the toner could not be achieved, and appropriate images could not be obtained.

In addition, the toner had also been charged inversely or adversely while the intermediate transferring belt was subjected to charging. Further, the toner had jumped onto the intermediate transferring belt through merely approaching the intermediate transferring belt to the photoconductor due to excessively high charging on the intermediate transferring belt.

COMPARATIVE EXAMPLE 2

An intermediate transferring belt was prepared in the same manner as Example 1, except that the rotating speed of the cylindrical cavity 13 was raised to 100 rpm after the pouring of solution containing polyamic acid mixture 101 was completed, and the centrifugal acceleration was 0.7 G at that time.

The surface resistivity ρs and the volume resistivity ρv of the intermediate transferring belt could not measured since these were outside the measurable range.

By means of the image forming apparatus, copies were prepared in the same manner as Example 1. As a result, appropriate images could not be obtained, since a significant transferring nonuniformity of the toner was induced due to variable carbon densities on the intermediate transferring belt, thus acceptable transfer of the toner could not be achieved.

COMPARATIVE EXAMPLE 3

An intermediate transferring belt was prepared in the same manner as Example 1, except that the rotating speed of the cylindrical cavity 13 was raised to 4000 rpm after the pouring of solution containing polyamic acid mixture 101 was completed, and the centrifugal acceleration was 1109 G at that time.

The surface resistivity ρs of the intermediate transferring belt was $6.0\times10^{8}$ ohm/square, and the volume resistivity ρv was $9.0\times10^{8}$ ohm·cm.

By means of the image forming apparatus, copies were prepared. Consequently, a proper electrophotographic process could not be achieved. Specifically, fine dust had generated while the toner was transferred from the image bearing member to the intermediate transferring belt, resulting in unsuccessful images.

More specifically, the transferring rate had dropped since the charge diffused into the belt inside due to the lower surface resistivity, in other words, the surface resistivity turned into the outer range of the proper semiconductive region due to the excessively high dispersion condition, i.e. the excessively high dispersion condition had decreased both of the surface resistivity and the volume resistivity.

Although the invention has been described in detail with reference to certain preferred embodiments for the purpose of illustration, it is to be understood that variations and modifications can be made by those skilled in the art without departing from the spirit and scope of the invention.

What is claimed is:

1. An intermediate transferring belt utilized to transfer a toner image formed by developing a latent image on an image bearing member by means of a toner, comprising:

a matrix, and conductive fine particles;

wherein the conductive fine particles are dispersed into the matrix;

the surface resistivity ρs of the outer surface of the intermediate transferring belt is $1.0\times10^{9}$ ohm/square to $1.0\times10^{13}$ ohm/square;

the volume resistivity ρv of the intermediate transferring belt is $1.0\times10^{6}$ ohm·cm to $1.0\times10^{11}$ ohm·cm; and the intermediate transferring belt is applied to an image forming apparatus of which the transferring electric field is controlled to 15 MV/m or less when the toner image on the image bearing member is primarily transferred to the intermediate transferring belt.

2. The intermediate transferring belt according to claim 1, wherein the surface resistivity ρs of the outer surface of the intermediate transferring belt is $1.0\times10^{9}$ ohm/square to $1.0\times10^{11}$ ohm/square.

3. The intermediate transferring belt according to claim 1, wherein the intermediate transferring belt is of mono-layer construction.

4. The intermediate transferring belt according to claim 1, wherein the intermediate transferring belt is of endless shape.

5. The intermediate transferring belt according to claim 1, wherein the intermediate transferring belt is formed by centrifugal molding.

6. The intermediate transferring belt according to claim 5, wherein the centrifugal acceleration at the centrifugal molding is in a range of 1.0 G to 1000 G.

7. The intermediate transferring belt according to claim 1, wherein a ratio of absolute specific gravity of the conductive fine particles (d2) dispersed into the matrix to the absolute specific gravity of matrix material (d1) is 1.3 or less as (d2/d1).

8. The intermediate transferring belt according to claim 1, wherein the matrix material is one of polyimide resin and polyamideimide resin.

9. The intermediate transferring belt according to claim 1, wherein the conductive fine particles are fine carbon particles.

10. The intermediate transferring belt according to claim 1, wherein the content of the conductive fine particles in the matrix is 5 to 25 parts by mass based on the 100 parts by mass of resin material in the matrix.

11. A process for producing an intermediate transferring belt utilized to transfer a toner image formed by developing a latent image on an image bearing member by means of a toner, comprising:

preparing a dispersion containing a matrix material and conductive fine particles, and subjecting the dispersion to centrifugal molding under 3.0 G to 1000 G of centrifugal acceleration, wherein the centrifugal acceleration is controlled at the centrifugal molding so as to adjust both the surface resistivity ρs of the outer surface of the intermediate transferring belt within a range of $1.0\times10^{9}$ ohm/square to $1.0\times10^{13}$ ohm/square and the volume resistivity ρv of the outer surface of the intermediate transferring belt within a range of $1.0\times10^{6}$ ohm·cm to $1.0\times10^{11}$ ohm·cm.

12. The process for producing an intermediate transferring belt according to claim 11, wherein the centrifugal acceleration is 300 G to 1000 G.

13. The process for producing an intermediate transferring belt according to claim 11, wherein the viscosity of the dispersion is 100 to 15000 cP at 25° C.

14. An image forming apparatus comprising:

an image bearing member capable of forming a latent image and bearing a toner image, a developing unit configured to develop a latent image on the image bearing member by means of a toner, an intermediate transferring belt configured to being primarily transferred the toner image developed by the developing unit, and a transferring unit configured to transfer secondarily the toner image on the intermediate transferring belt to a transfer sheet, wherein the intermediate transferring belt comprises a matrix and conductive fine particles, the conductive fine particles are dispersed into the matrix, the surface resistivity ρs of the outer surface of the intermediate transferring belt is $1.0\times10^{9}$ ohm/square to $1.0\times10^{13}$ ohm/square, the volume resistivity ρv of the intermediate transferring belt is $1.0\times10^{6}$ ohm·cm to $1.0\times10^{11}$ ohm·cm, and the intermediate transferring belt is primarily transferred the toner image under a transferring electric field of 15 MV/m or less.

15. An image forming process comprising:

developing a latent image on an image bearing member by means of a toner to form a toner image, transferring primarily the toner image on the image bearing member to an intermediate transferring belt, and transferring secondarily the toner image on the intermediate transferring belt to a transfer sheet, wherein the intermediate transferring belt comprises a matrix and conductive fine particles, the conductive fine particles are dispersed into the matrix, the surface resistivity ρs of the outer surface of the intermediate transferring belt is $1.0\times10^{9}$ ohm/square to $1.0\times10^{13}$ ohm/square, the volume resistivity ρv of the intermediate transferring belt is $1.0\times10^{6}$ ohm·cm to $1.0\times10^{11}$ ohm·cm, and the intermediate transferring belt is primarily transferred the toner image under a transferring electric field of 15 MV/m or less.

* * * * *